US009416794B2

(12) United States Patent
Liu

(10) Patent No.: US 9,416,794 B2
(45) Date of Patent: Aug. 16, 2016

(54) METHOD OF ASSEMBLING A SERIAL FAN

(71) Applicant: ASIA VITAL COMPONENTS (CHINA) CO., LTD., Shajing Branch, Baoan District, Shenzhen (CN)

(72) Inventor: Wen-Hao Liu, Shenzhen (TW)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 206 days.

(21) Appl. No.: 14/183,473

(22) Filed: Feb. 18, 2014

(65) Prior Publication Data

US 2015/0233387 A1 Aug. 20, 2015

(51) Int. Cl.

| | |
|---|---|
| ***F04D 19/02*** | (2006.01) |
| ***F04D 29/64*** | (2006.01) |
| *F04D 19/00* | (2006.01) |
| *F04D 29/66* | (2006.01) |

(52) U.S. Cl.

CPC ..... *F04D 29/646* (2013.01); *F04D 19/02* (2013.01); *F04D 19/007* (2013.01); *F04D 29/668* (2013.01); *F05D 2230/51* (2013.01); *Y10T 29/49327* (2015.01)

(58) Field of Classification Search

CPC .... B23P 15/26; B23P 2700/10; F04D 29/646; F04D 29/668; F04D 29/64; F04D 19/02; F04D 19/022; F04D 19/028; F04D 19/007; Y10T 29/49245; Y10T 29/49327

USPC ..... 415/66, 68, 213.1

See application file for complete search history.

(56) References Cited

U.S. PATENT DOCUMENTS

| | | | | |
|---|---|---|---|---|
| 6,556,437 | B1 * | 4/2003 | Hardin | H05K 7/20172 361/679.48 |
| 2014/0147312 | A1 * | 5/2014 | Lu | F04D 25/0613 417/423.14 |

* cited by examiner

*Primary Examiner* — Christopher Besler

(74) *Attorney, Agent, or Firm* — C. G. Mersereau Nikolai & Mersereau, P.A.

(57) ABSTRACT

A serial fan assembling method includes the steps of providing a first and a second fan; providing a union member having a bottom panel and two side panels, which together define a receiving space having a top forming a first open side and two axially opposite ends respectively forming a second open side; connecting the first fan to the side panels of the union member via the first open side; and connecting the second fan to the side panels of the union member via the first open side, or connecting the second fan to the bottom panel of the union member via one of the second open sides, so that the first and the second fan connected to the union member are serially located in the receiving space and connected to each other.

5 Claims, 12 Drawing Sheets

METHOD OF ASSEMBLING A SERIAL FAN

FIELD OF THE INVENTION

The present invention relates to a method of assembling a serial fan, and more particularly to a serial fan assembling method that effectively reduces the vibration produced by the assembled serial fan during operation thereof.

BACKGROUND OF THE INVENTION

People's reliance on various electronic devices increases with the constant progress in the electronic technology. It is known that internal electronic elements of various electronic devices, such as desktop computers, notebook computers and the like, will produce a large amount of heat during operation thereof. The produced heat must be timely guided off the electronic devices to avoid overheating of the electronic device. Therefore, most electronic devices are internally provided with a cooling fan for the devices to always operate at a predetermined working temperature.

Please refer to FIGS. 1A and 1B. A serial fan 1 known in the electronic industrial field includes a plurality of size-identical fan frames 10, a plurality of fan wheels 11 and a motor (not shown), which are assembled together to form the serial fan 1. When the serial fan 1 operates, it produces vibration as a result of the motor's operating torque. The conventional serial fan 1 is formed by serially connecting the fan frames 10 to one another via a fastening structure 12 provided on between any two adjacent fan frames 10. More specifically, the conventional serial fan 1 is formed by serially assembling a plurality of fan frames 10 in a direction parallel to a central axis thereof. With this assembling method, it is not able to change the serial fan's vibrating state. When the fan wheels 11 in the fan frames 10 rotate simultaneously, the vibration frequencies of the fan wheels 11 influence one another to induce a serious resonance effect between the fan frames 10. The vibration caused by this resonance effect is directly propagated from the fan frames 10 to other electronic elements of the electronic device, on which the serial fan 1 is mounted, such as the highly vibration-sensitive hard disk drive in a computer unit of the electronic device. Moreover, since the fan frames 10 in the conventional serial fan design are respectively formed as one single part, they are not able to effectively reduce the fan vibration. In some worse condition, the vibration produced by the motor and the fan wheels 11 would interfere with the normal operation of other electronic elements, preventing the whole system of the electronic device from reaching its best performance. Another disadvantage of the conventionally assembled serial fan 1 is that the resonance effect between the fan frames 11 also brings loud noise.

In brief, the prior art serial fan assembling method has the following disadvantages: (1) failing to effectively reduce the fan vibration; (2) being unable to eliminate noise caused by fan vibration; and (3) largely lowering the system hard disk drive access efficiency.

It is therefore tried by the inventor to develop an improved serial fan assembling method to eliminate the above-mentioned disadvantages.

SUMMARY OF THE INVENTION

A primary object of the present invention is to provide a method of assembling a serial fan, so that the assembled serial fan can largely reduce its vibration during operation.

Another object of the present invention is to provide a method of assembling a serial fan, so that the assembled serial fan can largely reduce its vibration during operation and therefore eliminate noise caused by the fan vibration.

A further object of the present invention is to provide a method of assembling a serial fan, so that two or more fans that together form the serial fan can be more quickly and precisely aligned with one another in the assembling process.

To achieve the above and other objects, the method of assembling a serial fan according to the present invention includes the following steps:

providing a first fan and a second fan, and the first fan having a first connection section;

providing a union member having a bottom panel and two side panels upward extended from two lateral sides of the bottom panel, such that a receiving space is defined between the bottom panel and the two side panels; and one side of the receiving space opposite to the bottom panel forming a first open side, while two axially opposite ends of the receiving space respectively forming a second open side; and connecting the first fan to the union member via the first open side with the first connection section on the first fan engaged with the two side panels of the union member, and connecting the second fan to the two side panels of the union member via the first open side or connecting the second fan to the bottom panel of the union member via one of the two second open sides, such that the first and the second fan connected to the union member are serially located in the receiving space.

According to the method of the present invention, after the first fan is connected to the union member via the first open side, the second fan can be connected to the union member via the first open side or the second open side. In either way, the first and the second fan, after being connected to the union member, are serially located in the receiving space in a manner capable of reducing the fan vibration. In addition, by connecting the first fan to the union member in a vertical direction relative to the union member and connecting the second fan to the union member in a vertical or a horizontal direction relative to the union member, the first and the second fan can be more quickly assembled together and more precisely aligned with each other.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
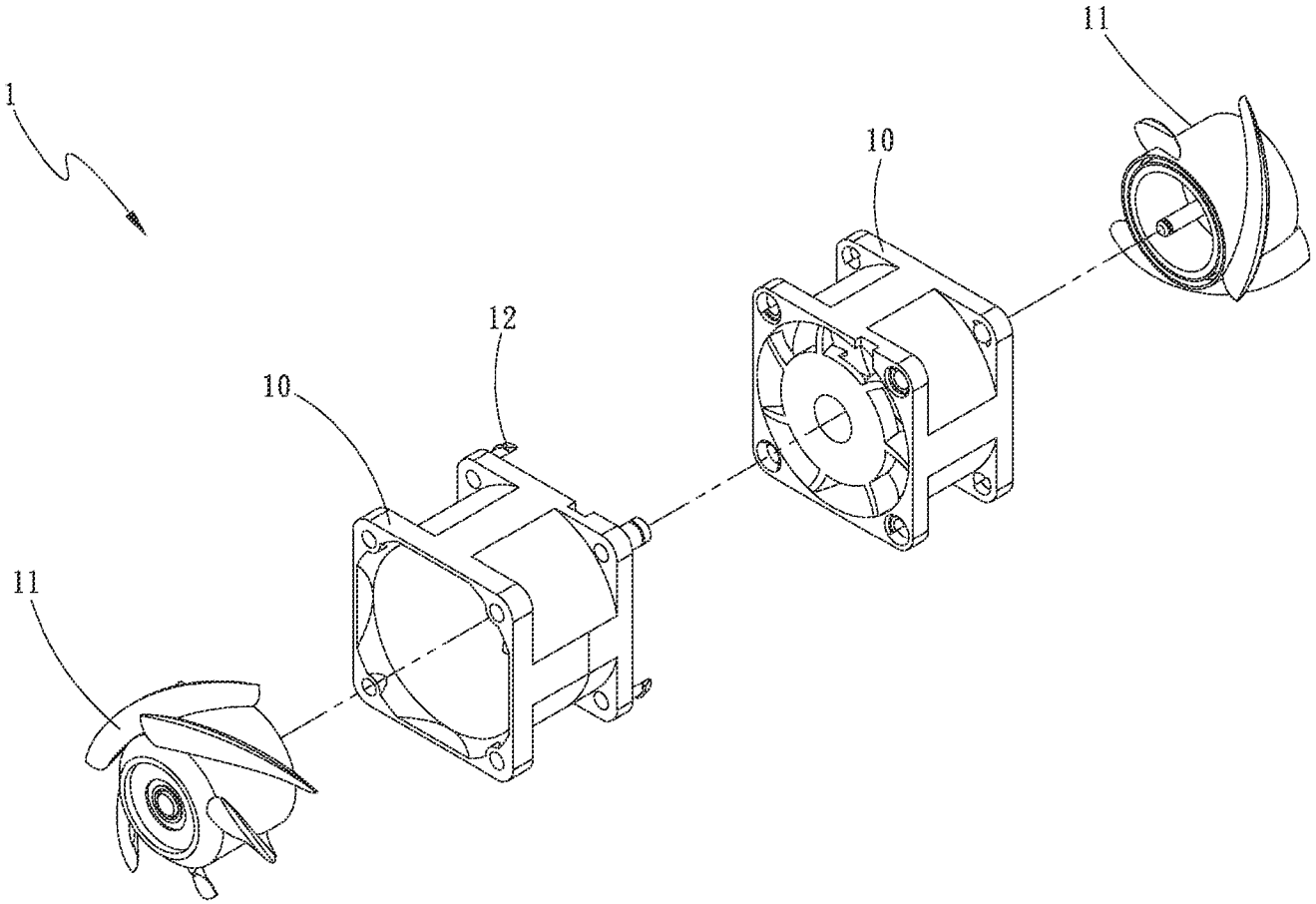
(PRIOR ART) Fig. 1A
FIG. 1A is an exploded perspective view showing a conventional method of assembling a serial fan.
Figure 1B:
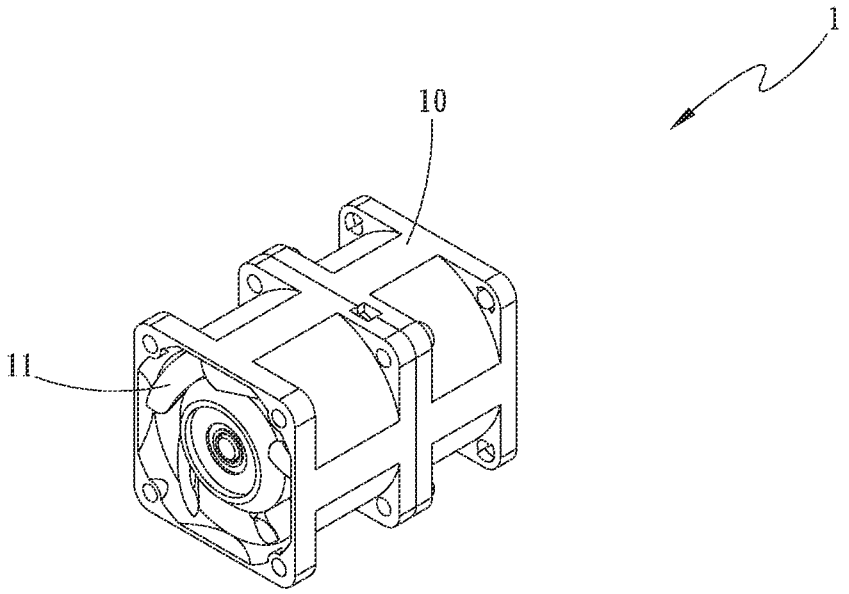
(PRIOR ART) Fig. 1B
FIG. 1B is an assembled view of FIG. 1A.

The present invention will now be described with some preferred embodiments thereof and with reference to the accompanying drawings. For the purpose of easy to understand, sections that are the same in the preferred embodiments are denoted by the same reference numerals.

Figure 2A:
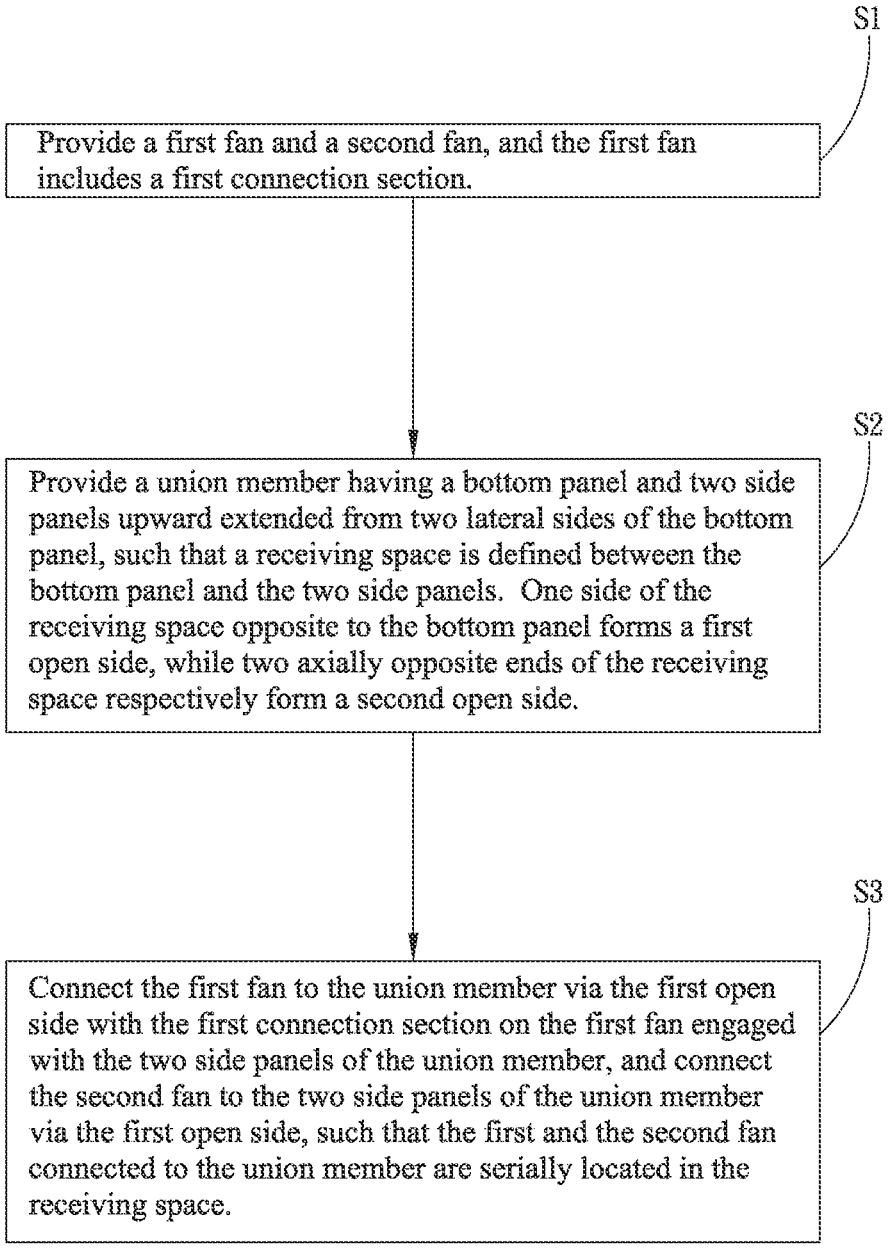
FIG. 2A is a flowchart showing the steps included in a method of assembling a serial fan according to a first embodiment of the present invention.
Figure 2B:
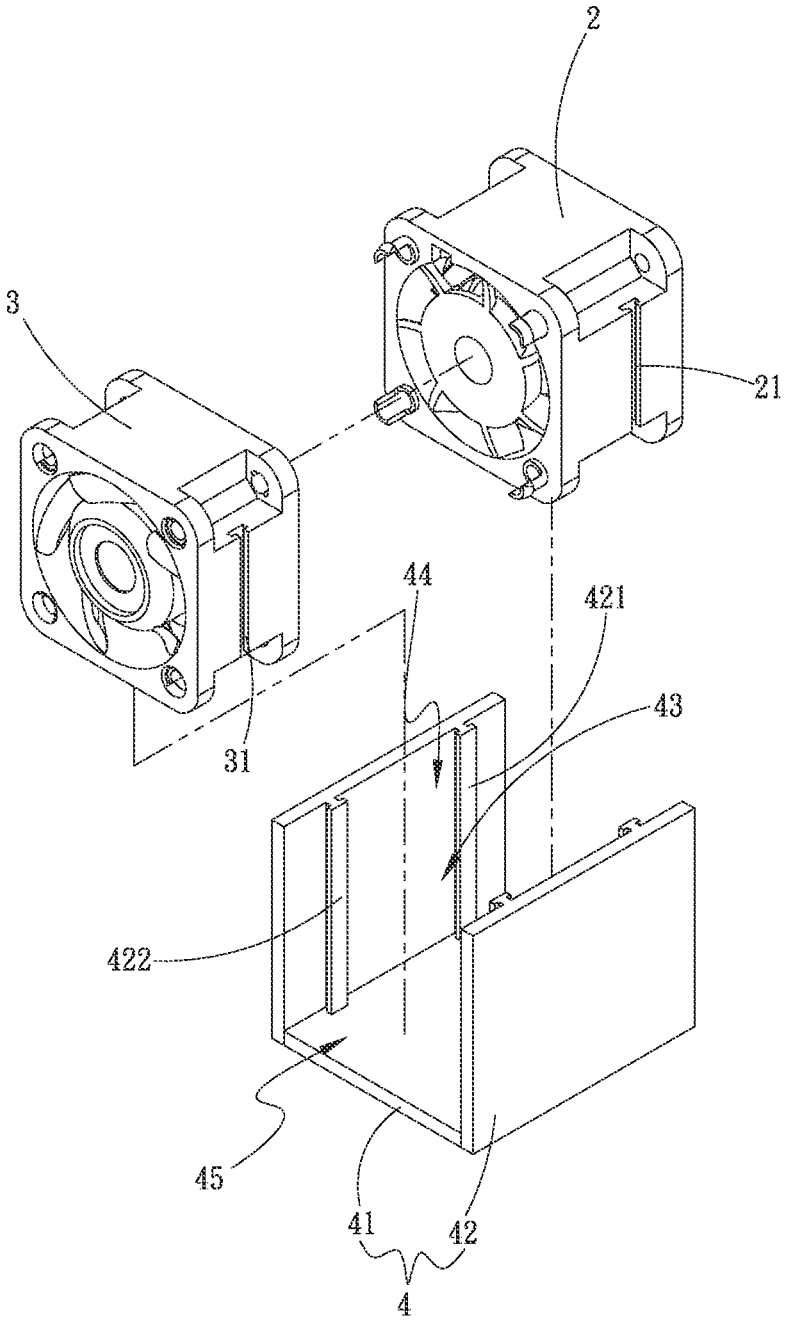
FIG. 2B is an exploded perspective view showing the method of assembling a serial fan according to the first embodiment of the present invention.
Figure 2C:
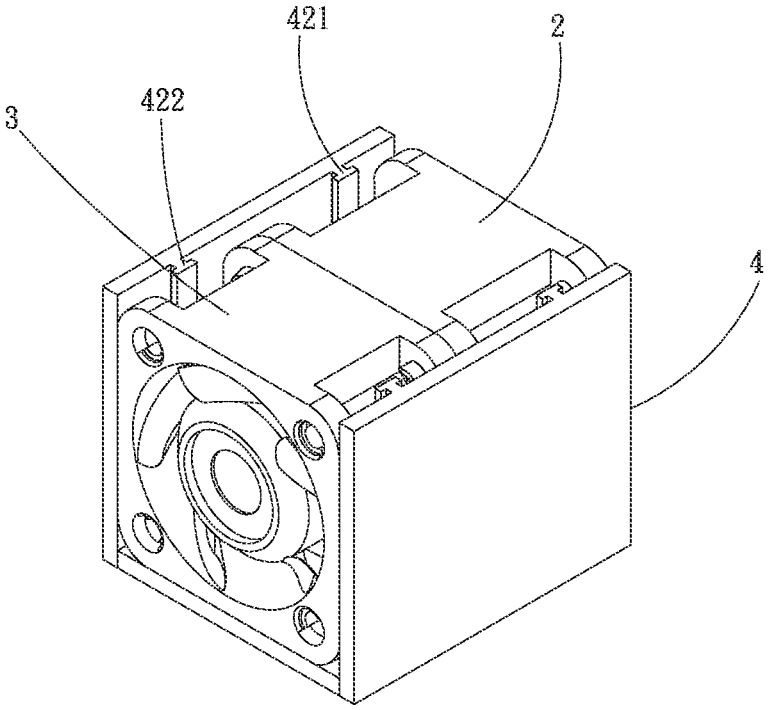
FIG. 2C is an assembled view of FIG. 2B.

The present invention provides a method of assembling a serial fan. Please refer to FIGS. 2A to 2C, wherein FIG. 2A is a flowchart showing the steps included in a first embodiment of the method, FIG. 2B is an exploded perspective view showing the assembling of a serial fan using the method of FIG. 2A, and FIG. 2C is an assembled view of FIG. 2B. As shown, in the first embodiment, the method of assembling a serial fan according to the present invention includes three steps S1, S2 and S3.

In the first step S1, a first fan and a second fan are provided, and the first fan includes a first connection section.

More specifically, in the first step S1 of the method of the present invention, a first fan 2 and a second fan 3 are provided. The first fan 2 includes a first connection section 21, and the second fan 3 includes a second connection section 31. In the first embodiment, the first and the second connection section 21, 31 are respectively illustrated as a channel. However, it is understood, in practical implementation of the present invention, the first and second connection sections 21, 31 are not necessarily limited to channels but can be otherwise slide rails, projected tongues or grooves.

In the second step S2, a union member is provided. The union member includes a bottom panel and two side panels upward extended from two lateral sides of the bottom panel, such that a receiving space is defined between the bottom panel and the two side panels. The receiving space has a top located opposite to the bottom panel and forming a first open side, and two axially opposite ends respectively forming a second open side.

More specifically, in the second step S2, a union member 4 is provided. The union member 4 includes a bottom panel 41 and two side panels 42 upward extended from two lateral sides of the bottom panel 41, such that a receiving space 43 is defined between the bottom panel 41 and the two side panels 42. One side of the receiving space 43 opposite to the bottom panel 41, i.e. a top side of the receiving space 43, forms a first open side 44, via which the receiving space 43 can be accessed in a vertical direction relative to the bottom panel 41; and two axially opposite ends of the receiving space 43 adjacent to two axially opposite ends of the bottom panel 41 form two second open sides 45, via any one of which the receiving space 43 can be accessed in a horizontal direction relative to the bottom panel 41.

In the third step S3, the first fan is connected to the union member via the first open side with the first connection section on the first fan engaged with the two side panels of the union member, and the second fan is also connected to the two side panels of the union member via the first open side, such that the first and the second fan connected to the union member are serially located in the receiving space.

More specifically, a first mating connection section 421 is provided on the two side panels 42 of the union member 4 for correspondingly engaging with the first connection section 21, and a second mating connection section 422 is further provided on the two side panels 42 of the union member 4 for correspondingly engaging with the second connection section 31. In the third step S3, the first fan 2 is connected to the side panels 42 of the union member 4 via the first open side 44, so that the first connection section 21 is engaged with the first mating connection section 421; and the second fan 3 is also connected to the side panels 42 of the union member 4 via the first open side 44, so that the second connection section 31 is engaged with the second mating connection section 422. In this manner, the first and the second fan 2, 3 connected to the union member 4 are serially located in the receiving space 43 to connect with each other end to end. In the first embodiment, the first and the second mating connection section 421, 422 are illustrated as slide rails. However, it is understood, in practical implementation of the present invention, the first and second mating connection sections 421, 422 are not necessarily limited to slide rails but can be otherwise channels, grooves or projected tongues.

In brief, in the first embodiment, while the first and second fans 2, 3 are connected to the union member 4 via engagement of channels with slide rails, it is understood the first and second fans 2, 3 can be connected to the union member 4 in many other different manners, such as clamping, screw fastening, gluing or snap fitting.

According to the present invention, the first fan 2 is connected to the union member 4 via the first open side 44 with the first connection section 21 correspondingly engaged with the first mating connection section 421, and the second fan 3 is also connected to the union member 4 via the first open side 44 with the second connection section 31 correspondingly engaged with the second mating connection section 422. That is, both of the first fan 2 and the second fan 3 are connected to the union member 4 in a vertical direction relative to the union member 4. In this connection manner, it is able to reduce or damp the serial fan's vibration effect. In addition, with the serial fan assembling method of the present invention, the first and second fans 2, 3 can be precisely and quickly located in the union member 4 to align with each other.

Figure 3A:
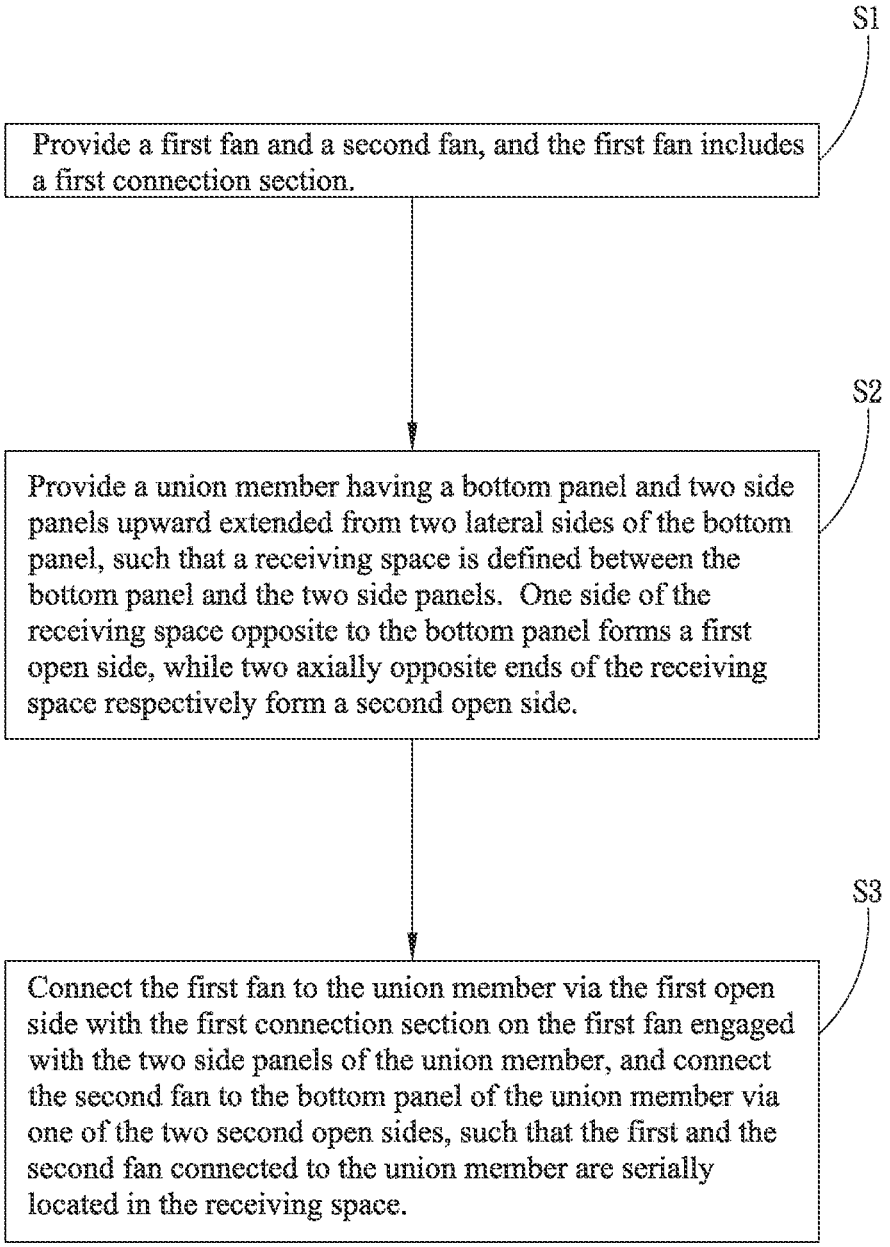
FIG. 3A is a flowchart showing the steps included in a method of assembling a serial fan according to a second embodiment of the present invention.
Figure 3B:
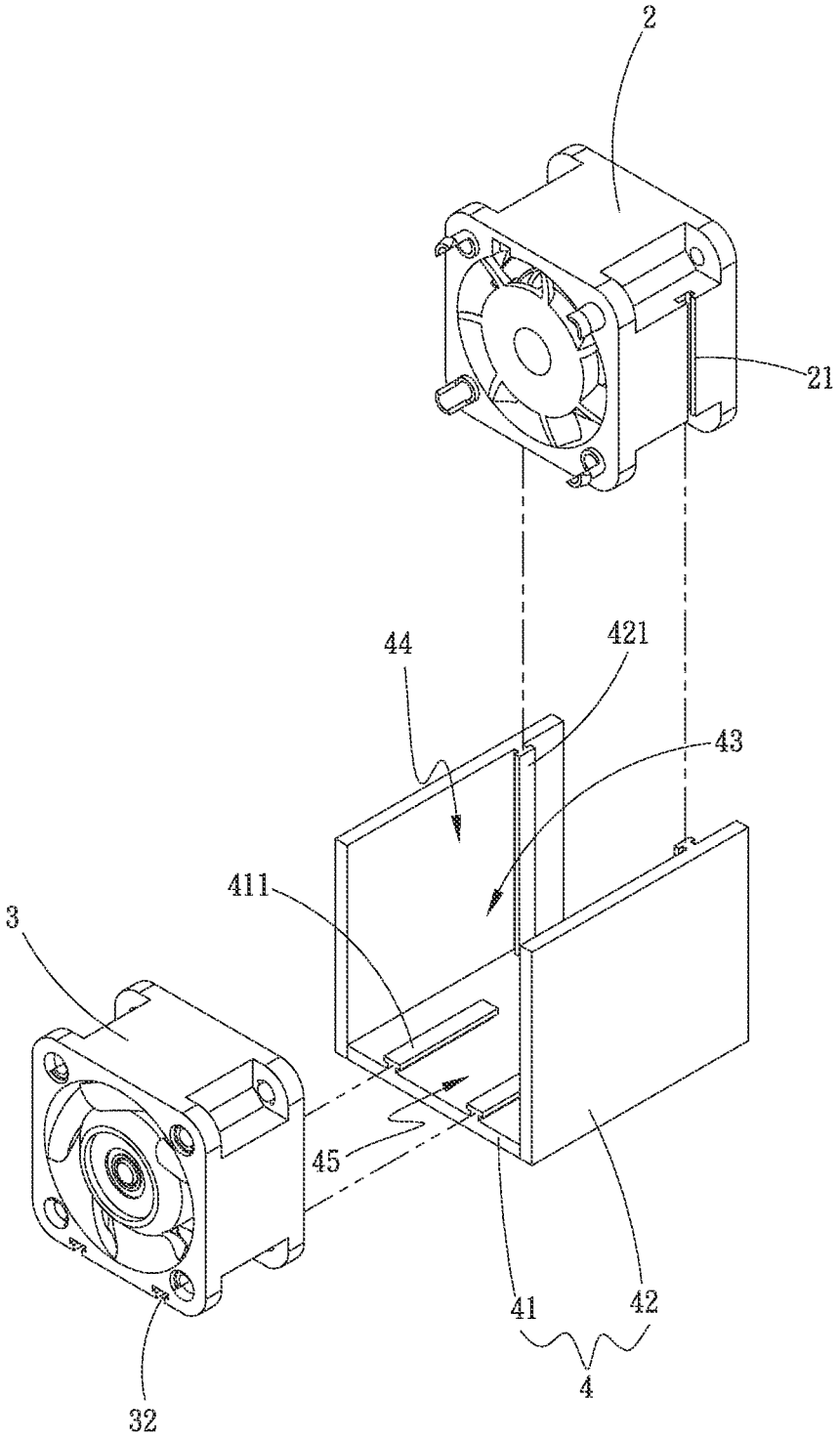
FIG. 3B is an exploded perspective view showing the method of assembling a serial fan according to the second embodiment of the present invention.
Figure 3C:
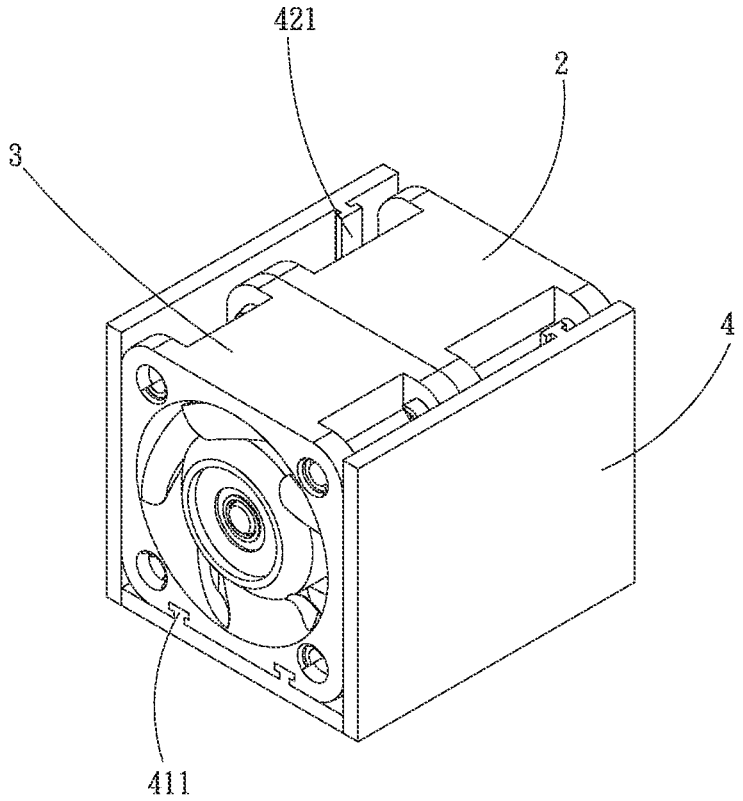
FIG. 3C is an assembled view of FIG. 3B.

Please refer to FIGS. 3A to 3C, wherein FIG. 3A is a flowchart showing the steps included in a second embodiment of the method of the present invention, FIG. 3B is an exploded perspective view showing the assembling of a serial fan using the method of FIG. 3A, and FIG. 3C is an assembled view of FIG. 3B. As shown, in the second embodiment, the method of assembling a serial fan according to the present invention also includes three steps S1, S2 and S3. The second embodiment is different from the first embodiment mainly in the third step S3, in which the first fan is connected to the union member via the first open side with the first connection section on the first fan engaged with the two side panels of the union member, while the second fan is connected to the bottom panel of the union member via the second open side, such that the first and the second fan connected to the union member are serially located in the receiving space.

More specifically, in the second embodiment, the second fan 3 includes a third connection section 32, and the bottom panel 41 of the union member 4 is provided with a third mating connection section 411 for correspondingly engaging with the third connection section 32. In the second embodiment, the third connection section 32 is illustrated as channels. However, it is understood, in practical implementation of the present invention, the third connection section 32 is not necessarily limited to channels but can be otherwise slide rails, projected tongues or grooves.

And, while the third mating connection section 411 in the second embodiment is illustrated as slide rails, it is understood, in practical implementation of the present invention, the third mating connection section 411 is not necessarily limited to slide rails but can be otherwise channels, grooves or projected tongues.

In the third step S3 of the second embodiment, the first fan 2 is connected to the side panels 42 of the union member 4 via the first open side 44, and the second fan 3 is connected to the bottom panel 41 of the union member 4 via one of the two second open sides 45 with the third connection section 32 on the second fan 3 engaged with the third mating connection section 411 on the bottom panel 41 of the union member 4. In other words, the first fan 2 is connected to the union member 4 in a vertical direction relative to the union member 4, while the second fan 3 is connected to the union member 4 in a horizontal direction relative to the union member 4. After the first and second fans 2, 3 are connected to the union member 4 in the above manner, the first and second fans 2, 3 are serially located in the receiving space 43 with reduced fan vibration and can be more precisely aligned with each other.

Figure 4:
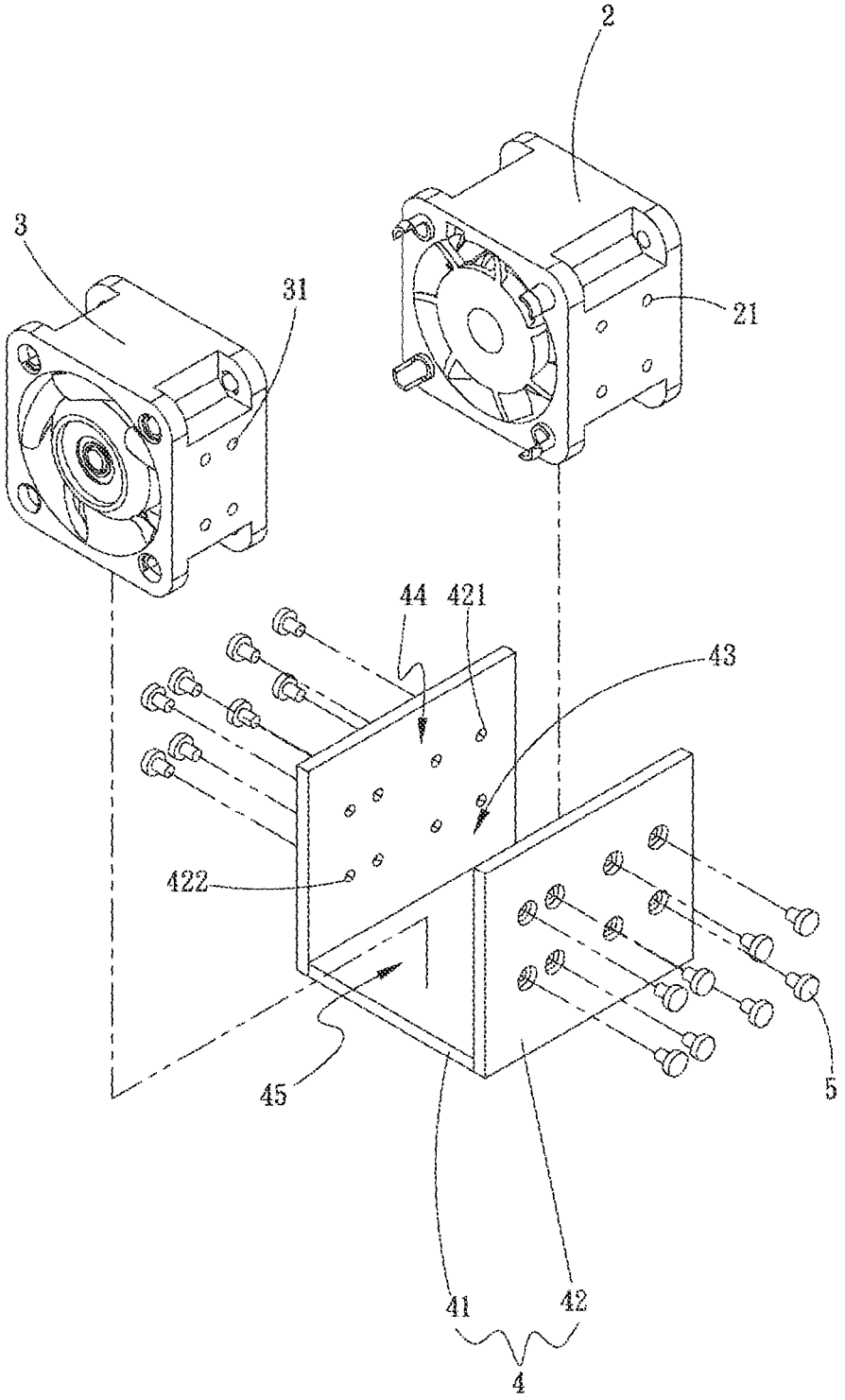
FIG. 4 is an exploded perspective view showing the method of assembling a serial fan according to a third embodiment of the present invention.
Figure 5:
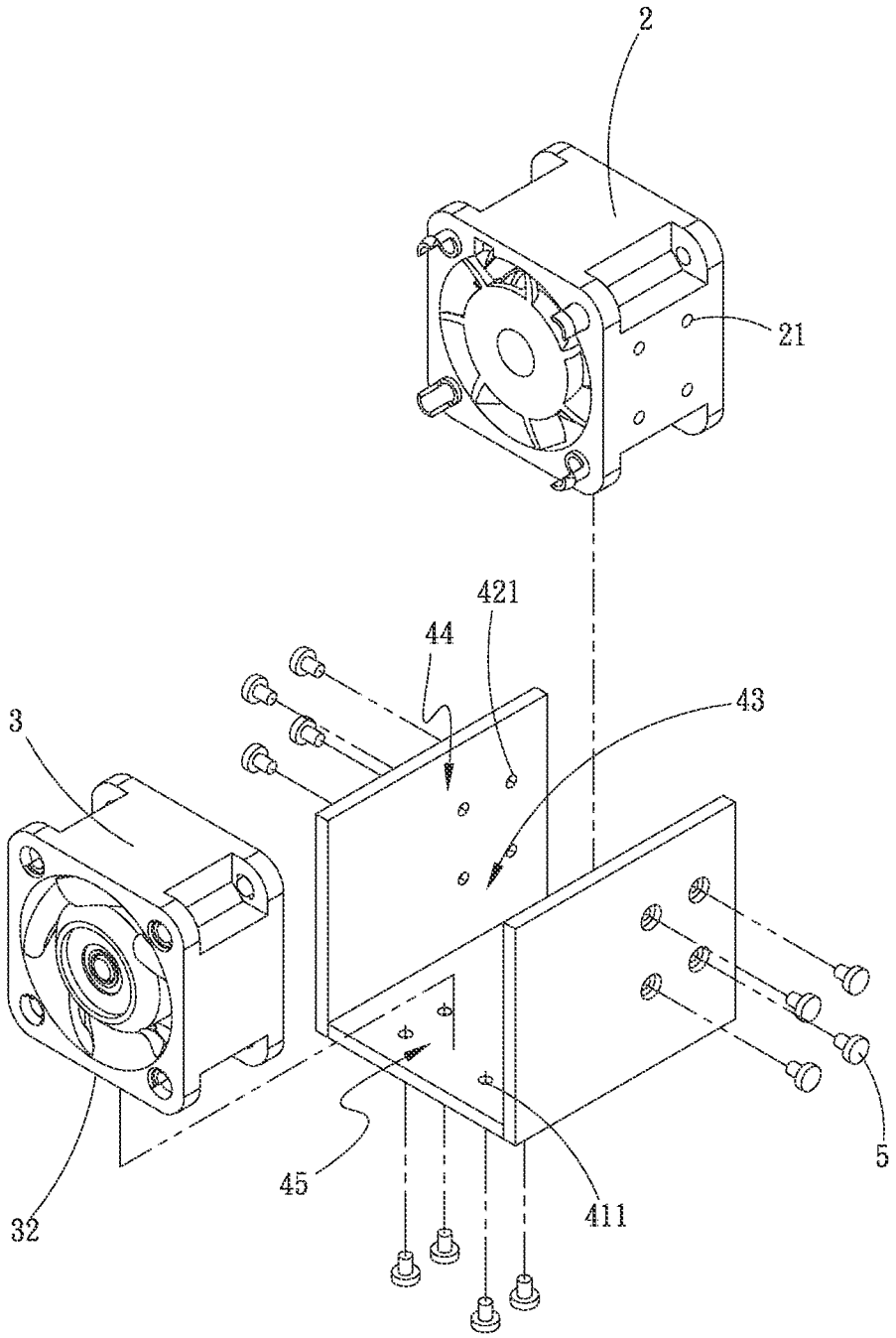
FIG. 5 is an exploded perspective view showing the method of assembling a serial fan according to a fourth embodiment of the present invention.

Please refer to FIGS. 4 and 5 that are exploded perspective views showing a third and a fourth embodiment, respectively, of the serial fan assembling method of the present invention. As shown, the steps included in the third and the fourth embodiment of the method of the present invention are generally similar to those in the first and the second embodiment, respectively. However, the first and the second connection section 21, 31 in the third embodiment as well as the first and the third connection section 21, 32 in the fourth embodiment respectively include a plurality of through holes, and the first and the second mating connection section 421, 422 in the third embodiment as well as the first and the third mating connection section 421, 411 in the fourth embodiment respectively include a plurality of openings corresponding to the through holes; and a plurality of fastening elements 5 is extended through the corresponding openings and through holes to connect the first and the second fan 2, 3 to the union member 4. Similarly, the first and the second fan 2, 3 can be both vertically connected to the union member 4 using the fastening elements 5, as in the third embodiment shown in FIG. 4; or alternatively, the first and the second fan 2, 3 can be vertically and horizontally, respectively, connected to the union member 4 using the fastening element 5, as in the fourth embodiment shown in FIG. 5. By assembling the serial fan in the methods according to the third and the fourth embodiment of the present invention, it is also able to achieve the advantages of reduced fan vibration and precise and quick alignment of the first and the second fan 2, 3 with each other.

Figure 6:
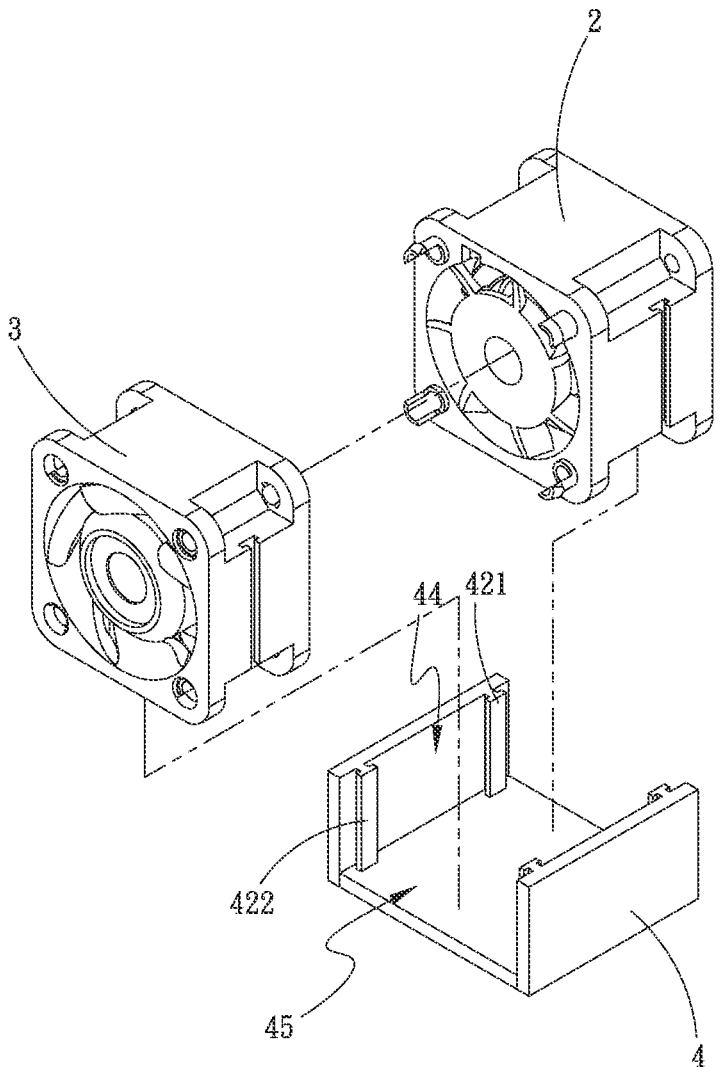
FIG. 6 is an exploded perspective view showing the method of assembling a serial fan according to a fifth embodiment of the present invention.
Figure 7:
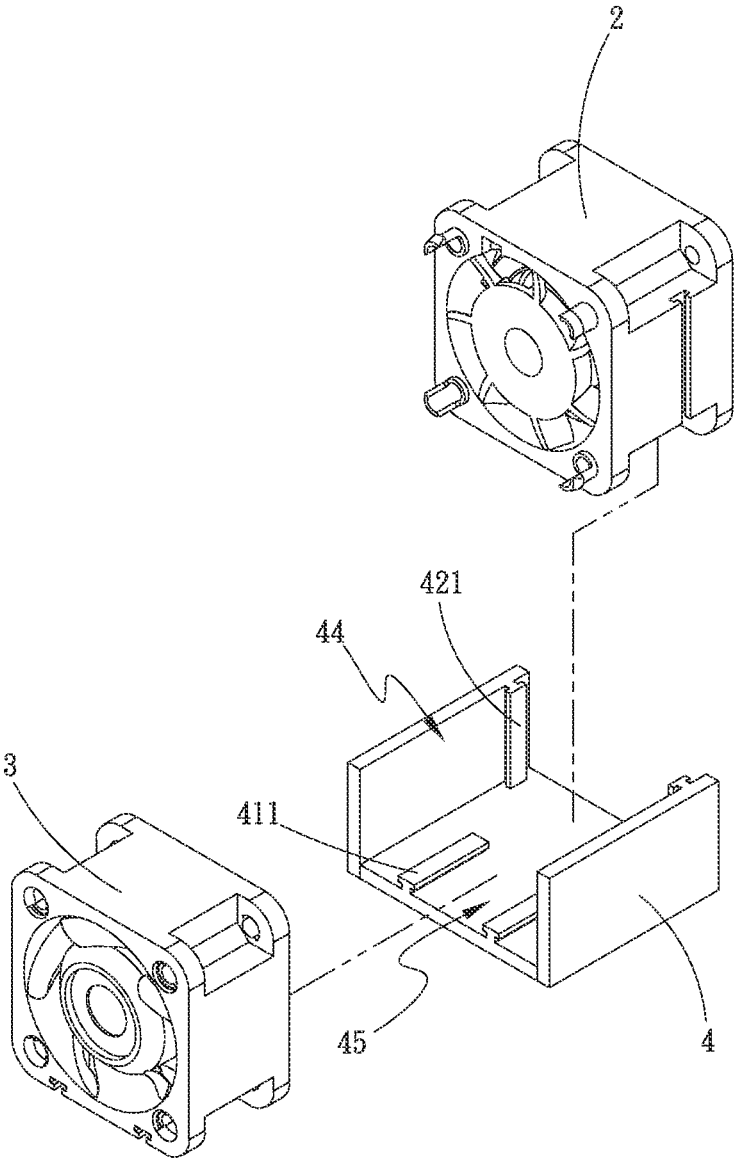
FIG. 7 is an exploded perspective view showing the method of assembling a serial fan according to a sixth embodiment of the present invention.

Please refer to FIGS. 6 and 7 that are exploded perspective views showing a fifth and a sixth embodiment, respectively, of the serial fan assembling method of the present invention. As shown, the steps included in the fifth and the sixth embodiment of the method of the present invention are generally similar to those in the first and the second embodiment, respectively, except that the union member 4 provided in the fifth and the sixth embodiment has a size variable according to the actual need in use, so that the serial fan so assembled can be in an optimal operation state.

According to the method of the present invention, the first and second fans for forming the serial fan can be assembled together by vertically or horizontally connecting them to a union member to eliminate the vibration resonance induced between the two fans and the noise caused by such vibration resonance. In summary, compared to the prior art serial fan assembling method, the present invention has the following advantages: (1) it largely reduces the fan vibration; (2) it minimizes the noise caused by the fan vibration; and (3) it enables all fans in the serial fan to precisely align with one another.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A method of assembling a serial fan, comprising the following steps:

providing a first fan and a second fan, the first fan having a first connection section and the second fan having a third connection section;

providing a union member having a bottom panel, two side panels upward extended from two lateral sides of the bottom panel, a first mating connection section formed on the two side panels at a position corresponding to the first connection section on the first fan, and a third mating connection section formed on the bottom panel at a position correspondingly to the third connection section of the second fan, such that a receiving space is defined between the bottom panel and the two side panels; and one side of the receiving space opposite to the bottom panel forming a first open side, while two axially opposite ends of the receiving space respectively forming second open sides; and connecting the first fan to the union member in a vertical manner via the first open side with the first connection section on the first fan engaged with the first mating connection section, and connecting the second fan to the union member in a horizontal manner via one of the two second open sides with the third connection section on the second fan engaged with the third mating connection section, such that the first and the second fan connected to the union member are serially located in the receiving space.

2. The serial fan assembling method as claimed in claim 1, wherein the first and the third connection section are respectively selected from the group consisting of slide rails, channels, grooves and projected tongues.

3. The serial fan assembling method as claimed in claim 1, wherein the first and the third mating connection section are respectively selected from the group consisting of channels, slide rails, projected tongues and grooves.

4. The serial fan assembling method as claimed in claim 1, wherein the first and second fans are respectively connected to the union member in a manner selected from the group consisting of engaging of channels with slide rails, clamping, screw fastening, gluing and snap fitting.

5. The serial fan assembling method as claimed in claim 1, wherein the first, the second and the third connection section respectively include a plurality of through holes, and the first, the second and the third mating connection section respectively include a plurality of openings corresponding to the through holes of the first, the second and the third connection; and a plurality of fastening elements being extended through the corresponding openings and through holes to connect the first and the second fan to the union member.

* * * * *